United States Patent [19]

Zhadanov

[11] Patent Number: 4,574,414

[45] Date of Patent: Mar. 11, 1986

[54] KITCHEN APPLIANCE

[76] Inventor: Sam Zhadanov, 2944 W. 5th St., Brooklyn, N.Y. 11224

[21] Appl. No.: 656,276

[22] Filed: Oct. 1, 1984

[51] Int. Cl.[4] ..... A47L 15/00; A46B 13/06

[52] U.S. Cl. ..... 15/74; 15/3; 15/24; 15/71; 15/75

[58] Field of Search ..... 15/74, 75, 24, 29, 56, 15/65, 97 R, 70, 71, 3, 4

[56] References Cited

U.S. PATENT DOCUMENTS

| | | | |
|---|---|---|---|
| 491,374 | 2/1893 | Robinson | 15/75 |
| 602,190 | 4/1898 | Evans | 15/65 X |
| 1,305,358 | 6/1919 | Hapgood | 15/29 |
| 1,837,904 | 12/1931 | Hanelt | 15/24 |
| 2,019,705 | 11/1935 | Hubert | 15/74 |
| 3,046,585 | 7/1962 | Ledingham et al. | 15/24 |
| 3,909,867 | 10/1975 | Hogsell | 15/24 |

FOREIGN PATENT DOCUMENTS

| | | | |
|---|---|---|---|
| 511750 | 1/1955 | Italy | 15/75 |

*Primary Examiner*—Edward L. Roberts
*Attorney, Agent, or Firm*—Ilya Zborovsky

[57] ABSTRACT

A kitchen appliance has a housing with an inlet opening for admitting water, a rotor rotatable in the housing, a brush member connected with the rotor for joint rotation therewith, a first smaller opening for supplying a smaller portion of water to the brush member for mixing with a soap, and a second greater outlet opening for exiting a greater portion of water for rinsing a dish or the like washed by the brush member.

14 Claims, 3 Drawing Figures

KITCHEN APPLIANCE

BACKGROUND OF THE INVENTION

The present invention relates to kitchen appliances, and particularly to such appliances which are used for dish washing and the like.

Known kitchen appliances of the above-mentioned type use as a rule conventional sources of energy, such as for example electric energy. They are energy consuming, have complicated constructions, and are not easy to handle. Water brushes known for washing various objects, such as for example cars, human body, and the like. Such water brushes are disclosed for example in the U.S. Pat. Nos. 4,228,558 and 4,374,444. In these brushes water which rotates a rotor used for rotation of a brush member is supplied exclusively to the brush member for washing. This is however not applicable for a dish washing kitchen appliance, since during dish washing process it is first necessary to soap a dish or the like with a small quantity of water, and thereafter rinse the dish with a greater quantity of water without soap. This separation of functions is not provided in the known water brushes.

SUMMARY OF THE INVENTION

Accordingly, it is an object of the present invention to provide a kitchen appliance for dish washing and the like, which avoids the disadvantages of the prior art.

In keeping with these objects and with others which will become apparent hereinafter, one feature of the present invention resides, briefly stated, in a kitchen appliance for dish washing which has a housing, a rotor rotatable in a housing under the action of water admitted into the housing, an inlet opening, and two separate outlet openings formed so that a smaller portion of water flows through a first smaller outlet opening to a brush member rotatable by the rotor, whereas a greater portion of water flows through a second greater opening for rinsing a dish or the like washed by the brush member.

When a kitchen appliance is designed in accordance with the present invention, a soap is supplied to the brush member and mixed with a small quantity of water to form a foam and to wash a dish or the like, whereupon the dish is placed under the second opening and a greater stream of water rinses it.

In accordance with another advantageous feature of the present invention, the housing has a generally cylindrical portion in which the rotor is located, and an additional portion located between the cylindrical portion and the greater outlet opening so as to reduce resistance to exiting of water from the housing through the greater outlet opening.

In accordance with still a further feature of the present invention, the greater outlet opening extends transverse to the axis of the rotor and parallel to the axis of the inlet opening.

A further feature of the present invention is that a knife sharpening element is connected with the rotor for joint rotation therewith and located between the rotor and the brush member.

Still a further feature of the present invention is that the appliance is provided with a soap container which is formed as a handle and has a foam supplying element extending through the brush.

The novel features of the present invention are set forth in particularly in the appended claims. The invention itself will best understood from the following description of the preferred embodiment, which is accompanied by the following drawings.

DESCRIPTION OF A PREFERRED EMBODIMENT

Figure 1:
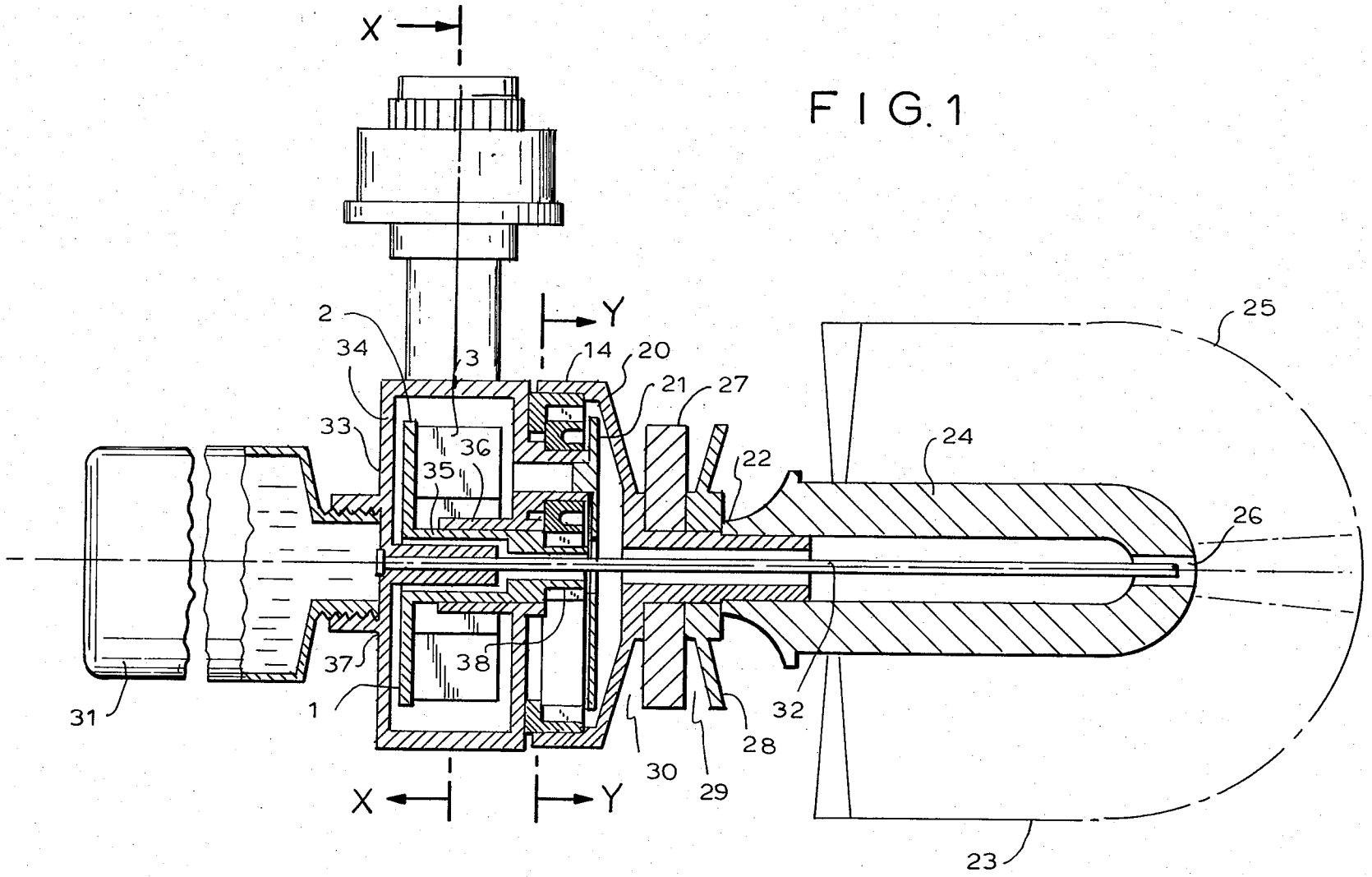
FIG. 1 is a partially sectioned view of a kitchen appliance for dish washing and the like in accordance with the present invention, substantially in a position in which it is attachable to a faucet of a water system.

A kitchen appliance for dish washing and the like in accordance with the present invention has a rotor which is identified as a whole with reference numeral 1 and has a base 2 and a plurality of blades 3. The appliance has a housing which is identified as a whole with reference numeral 4 and has a generally cylindrical portion 5 in which the rotor 1 is arranged eccentrically so that a space of a variable cross section is formed between the outer ends of the blades of the rotor and the inner wall of the cylindrical portion of the housing. The housing has an inlet opening 6 for admitting water which flows through an inlet pipe 7 forming an integral part of the housing. A quick coupling is further provided for attaching the inlet pipe 7 to a faucet of a household water system. In includes a bush 8 provided with slots 9 and spring-biased by a spring 10 and a plurality of engaging members 11 located inside the bush 10 and retained by a retaining member 12. For attaching the inlet pipe 7 to a fitting 13 of a faucet, it suffices to press the inlet pipe 7 with the quick coupling upwardly onto the fitting 13 so that the engaging members 11 engage behind the shoulder of the fitting. For removing the inlet pipe 7 from the fitting, it suffices to retract downwardly the bush 8 so that the engaging members 11 enter the recesses 9 and thereby move radially outwardly to allow the fiting 13 to pass therebetween.

A platform 14 is annular and provided with teeth 15 which engage with the outer teeth 16 of planetary gears 17. The outer teeth 16 of the planetary gears 17 engage in turn outer teeth 18 of a sun gear 19 formed on the rotor 1. A flange element 20 engages an outer surface of the platform 14 with snap action. For this purpose the inner surface of the flange element 20 and the outer surface of the platform 14 can be formed conical. A cover 21 covers one axial side of the above-described gear transmission. The flange element 20 has an elongated central part 22, and a brush member 23 is fixed on this part. The brush member 23 has a body 24 and a plurality of bristles 25. The body 24 is hollow and provided with an outlet opening 26. A grinding disk 27 is also fixedly mounted on the elongated part 22, substantially between the rotor 1 and the brush member 23. A limiting member 28 is also fixedly arranged on the elongated part 22 so as to limit a recess 29 between the grinding disk 27 and the member 28. A second recess 30 is formed between the grinding disk 27 and the flange 20.

A soap container 31 is removably attached to the housing, for example screwed; it can be removed from the housing and filled with a soap. A thin soap supplying pipe 32 extends from the region of the soap container 31 through the housing, the rotor and the brush member to the outlet opening 26 of the latter. The soap container is flexible so that its wall can be squeezed to expel the soap. It is composed for example of a flexible plastic.

A first outlet is provided for supplying water into the brush member. It substantially includes a passage 33 between the rear side of the base of the rotor 1 and a left wall 34 of the housing, a passage 35 between a central part 36 of the rotor and a central part 37 of the housing, and a further passage 38 between a front portion of the central part of the rotor and the soap supplying element 32. This outlet is of a small cross section and supplies a smaller quantity of water into the brush member. A second outlet is formed in the housing and identified reference numeral 40. It has a greater cross section and therefore allows a greater quantity of water to exit from the housing. It is subdivided by a plurality of partitions 41 into a plurality of small passages 42 so as to break an outlet water stream into a plurality of small jets. An additional portion 43 is formed in the housing between the cylindircal portion 5 and the second outlet 40.

The kitchen appliance in accordance with the present invention operates in the following manner. When the inlet pipe 7 is attached to the fitting 13 of the faucet and the faucet is opened, water flows into the inlet pipe 7 and through the inlet opening 6 into the housing 1. The water exiting the opening 6 flows under the pressure onto the blades of the rotor, rotates the rotor and also creates a vortex in the central area between the blades so as to provide for an additional impulse for the blades. The rotation is transmitted through the transmission to the rotatable member 20 and thereafter to the brush member 23. Water exits through the outlet 40. There is actually no water in the central zone of the rotor and in the passages 33, 35 and 38 since water is thrown radially outwardly by the blades. For washing a dish or the like, the dish is brought into contact with the bristles 25 of the brush member 23. This contact somewhat reduces the speed of rotation of the brush member 23 and also of the rotor 1. As a result of this, water is no longer thrown completely radially outwardly of the rotor, but instead fills the housing and flows through the passages 33, 35 and 38 into the brush 23 and through the opening 26 between the bristles 25, in relatively small quantity. By squeezing the soap container 31 the soap is supplied through the soap supplying pipe 32 and the opening 26 between the bristles 25, and is mixed there with water. The dish is washed by the soapy and wet bristles 25. In order to increase the quantity of water supplied into and out of the brush member, a user can hold the rotatable member 20 and partially or completely stop the rotor 1. Thereby the quantity of water supplied through the passages and the brush member will further increase.

During this washing process a greater quantity of water flows outwardly of the outlet 40. After washing, a dish is placed under the outlet 40 and a clean water in a greater quantity rinses the dish. It is to be understood that any household item can be washed and rinsed in such a manner.

For sharpening a knife or another object, the knife is inserted into the recess 29 or 30 and pressed against the surface of the disk 27 to be sharpened by the latter. The knife can be rinsed by water exiting the outlet 40 and again sharpened against the disk 27.

Figure 2:
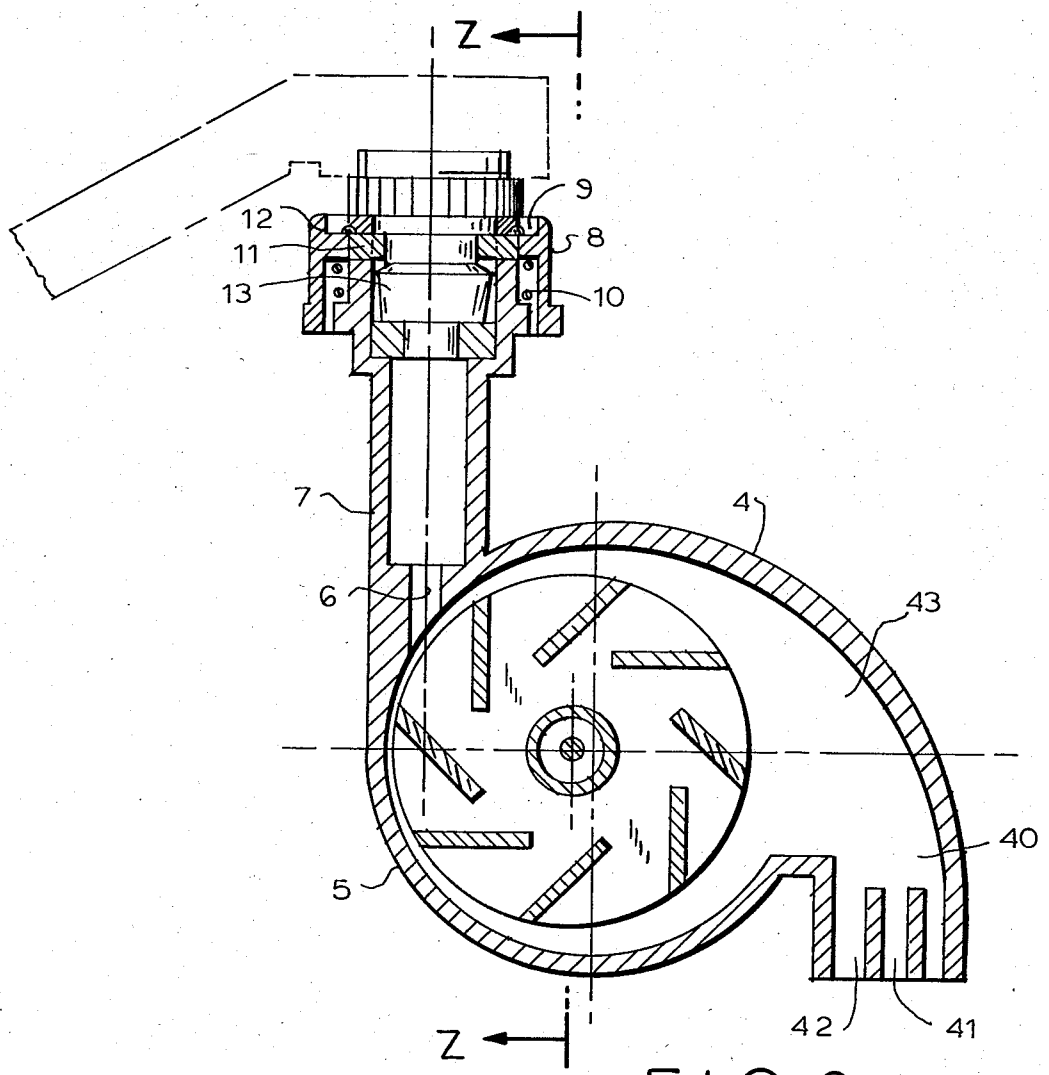
FIG. 2 is a view showing a section of the inventive kitchen appliance taken along the line X—X in FIG. 1.
Figure 3:
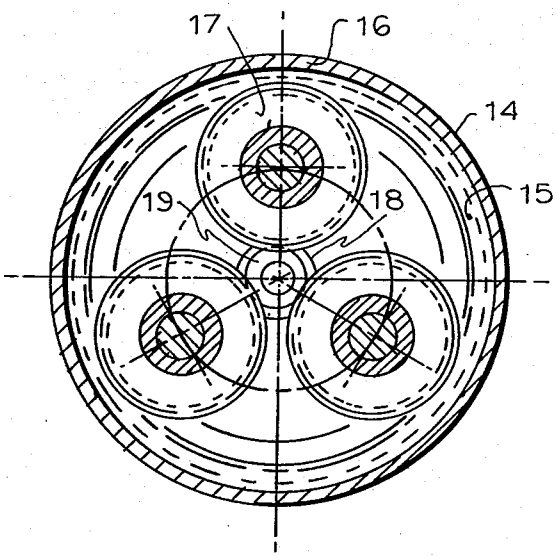
FIG. 3 is a view showing a section taken along the line Y—Y of the inventive kitchen appliance in FIG. 1.

During rotation of the rotor water admitted through the inlet opening 6 into the housing is forcedly thrown by the blades of the rotor in upward direction as considered in FIG. 2. The additional portion 43 which is provided between the cylindrical portion 5 of the housing 5 and the outlet 40 forms an additional free space and thereby reduces resistance to exiting of water from the housing through the outlet 40.

The quick coupling provided on the inlet 7 is formed so that the inlet pipe can be rotated by a user about its axis and therefore the appliance can be rotated about this axis. Therefore the brush member can be placed in any position relative to a sink in a household application.

The invention is not limited to the details shown, since various modifications and structural changes are possible without departing in any way from the spirit of the present invention.

I claim:

1. A kitchen appliance for dish washing and the like, comprising a housing having a generally cylindrical portion; means forming a water inlet opening for said housing; a rotor having an axis and mounted within said cylindrical portion of said housing eccentrically with respect to the same, said rotor including a base having a plurality of blades mounted thereon, said blades being so positioned that they are rotated by the force of water exiting said inlet opening, said blades extending substantially radially of said rotor having a gap between the inner end of each blade and said axis of said rotor providing means for dissipation of water under pressure thereinto; a brush member connected with said rotor for rotation therewith; means forming a first outlet opening which is smaller and through which a smaller portion of water exits to said brush member to be mixed with a soap; means forming a second outlet opening which is greater and through which a greater portion of water exits for rinsing a dish or the like after washing with said brush member; and soap supplying means including a soap container and a soap supplying element extending through said brush member.

2. A kitchen appliance as defined in claim 1, wherein said first outlet opening is substantially coaxial with said rotor, whereas said second outlet opening extends substantially transversely to said axis of said rotor.

3. A kitchen appliance as defined in claim 1, wherein said inlet opening has an axis, said second outlet opening having an axis extending in the direction of said axis of said inlet opening substantially parallel thereto.

4. A kitchen appliance as defined in claim 1; and further comprising a rotatable element located between and connected with said rotor and said brush member, said rotatable element being arranged outside of said housing so as to available for stopping by a user with resulting stopping of said rotor and supplying water through said first outlet opening to said brush member.

5. A kitchen appliance as defined in claim 4; and further comprising transmission means located between and arranged to transmit rotation of said rotor to said rotatable member.

6. A kitchen appliance as defined in claim 5, wherein said transmission means includes a plurality of gear members arranged with gaps there around so as to provide lubrication of said gear members by the water.

7. A kitchen appliance as defined in claim 1, wherein said housing has an additional portion extending between said generally cylindrical portion and said second outlet opening and forming in the region of said additional portion an increased space between said housing and said rotor so as to reduce resistance to exiting of water from said housing through said second outlet opening.

8. A kitchen appliance as defined in claim 1, wherein said soap container is formed as a handle to be grasped by a user so as to turn said housing with said rotor and said brush member about an axis substantially transverse to said axis of rotor.

9. A kitchen appliance as defined in claim 1, wherein said first outlet opening is formed between said rotor and said soap supplying element.

10. A kitchen appliance as defined in claim 1, wherein said knife-sharpening element is located between said rotor and said brush member.

11. A kitchen appliance as defined in claim 1; and further comprising at least one limiting member located at least one axial side of said knife-sharpening member and forming together with the latter a recess for inserting a part of a knife to be sharpened.

12. A kitchen appliance as defined in claim 1; and further comprising an inlet pipe connecting with said inlet opening and provided with means for quick coupling of said inlet pipe with a faucet of a water supply system.

13. A kitchen appliance as defined in claim 12, wherein said inlet pipe has an axis, said quick coupling being formed so that upon coupling of said pipe with a faucet, said housing together with said rotor and said brush member can rotate about said axis of said pipe.

14. A kitchen appliance for dish washing and the like, comprising a housing having a generally cylindrical portion; means forming a water inlet opening for said housing; a rotor having an axis and mounted within said cylindrical portion of said housing eccentrically with respect to the same, said rotor including a base having a plurality of blades mounted thereon, said blades being so positioned that they are rotated by the force of water exiting said inlet opening, said blades extending substantially radially of said rotor having a gap between the inner end of each blade and said axis of said rotor providing means for dissipation of water under pressure thereinto; a brush member connected with said rotor for rotation therewith; means forming a first outlet opening which is smaller and through which a smaller portion of water exits to said brush member to be mixed with a soap; means forming a second outlet opening which is greater and through which a greater portion of water exits for rinsing a dish or the like after washing with said brush member; and a knife-sharpening disc connected with said rotor and rotatable therewith.

* * * * *